US008138436B2

(12) United States Patent
Grant et al.

(10) Patent No.: US 8,138,436 B2
(45) Date of Patent: Mar. 20, 2012

(54) KEYPAD WITH CANTILEVER KEYS

(75) Inventors: Silas Joe Grant, London (GB); Tom Eaton, Gloucestershire (GB)

(73) Assignee: Nokia Corporation, Espoo (FI)

( * ) Notice: Subject to any disclaimer, the term of this patent is extended or adjusted under 35 U.S.C. 154(b) by 241 days.

(21) Appl. No.: 12/381,493

(22) Filed: Mar. 11, 2009

(65) Prior Publication Data

US 2010/0230264 A1 Sep. 16, 2010

(51) Int. Cl.
*H01H 3/20* (2006.01)

(52) U.S. Cl. ..... 200/332; 200/314

(58) Field of Classification Search ..... 200/332
See application file for complete search history.

(56) References Cited

U.S. PATENT DOCUMENTS 4,323,740 A * 4/1982 Balash ..... 200/5 A
6,195,082 B1 * 2/2001 May et al. ..... 345/161
7,005,588 B2 * 2/2006 Pihlaja ..... 200/5 A

* cited by examiner

*Primary Examiner* — Edwin A. Leon
*Assistant Examiner* — Vanessa Girardi
(74) *Attorney, Agent, or Firm* — Harrington & Smith

(57) ABSTRACT

An apparatus including: a substrate; a keypad including a plurality of distinct rigid elongate keys wherein each elongate key includes: a first end portion supported by the substrate and a second end portion separated by a dimension of the elongate key from the first end portion, and suspended from the substrate in free space by the elongate key; and a plurality of switches, wherein each switch detects travelling towards the substrate of the second end portion of a respective one of the plurality of elongate keys in response to user actuation of the second end portion.

7 Claims, 4 Drawing Sheets

KEYPAD WITH CANTILEVER KEYS

FIELD

Embodiments of the present invention relate to a keypad.

BACKGROUND

A key of a keypad typically travels when actuated by a user to activate an underlying switch. There is typically some form of resilient bias to return the key to its neutral equilibrium position after actuation by the user.

There are various technical issues that affect the design of keypads. A key needs to be reliable, but there may be other constraints such as cost and 'quality'. Quality may, for example, relate to the tactile response of a key when actuated by a user.

Some keypads require many components to ensure that the keys travel without skewing and becoming stuck and/or to achieve the requisite tactile feedback. Although these keys may be reliable and provide good tactile feedback to a user they are relatively expensive.

Other keypads use elastomeric mats to actuate underlying key domes. These keypads are typically cheaper and the key dome may provide some tactile feedback. However, there may be little travel in the keys when actuated.

There are many other existing implementations of keys and keypads that typically trade certain advantages for certain disadvantages.

It would be desirable to provide a new keypad that operates efficiently, has few moving parts and provides good tactile feedback to a user.

BRIEF DESCRIPTION

According to various, but not necessarily all, embodiments of the invention there is provided an apparatus comprising: a substrate; a keypad comprising a plurality of distinct substantially rigid elongate keys wherein each elongate key comprises: a first end portion supported by the substrate and a second end portion separated by a dimension of the elongate key from the first end portion, and suspended from the substrate in free space by the elongate key; and a plurality of switches, wherein each switch is configured to detect travelling towards the substrate of the second end portion of a respective one of the plurality of elongate keys in response to user actuation of the second end portion, Each of the plurality of switches may be a physically actuated switch underlying the second end portion and wherein travelling of the second end portion of an elongate key, in response to user actuation of the second end portion, actuates the underlying physically actuated switch.

The underlying physically actuated switches may be exposed and visible to a user.

Each of the plurality of switches may comprise a strain gauge positioned at the first end portion of each elongate key wherein travelling of the second end portion of an elongate key, in response to user actuation of the second end portion, strains the first portion of the elongate key actuating the strain gauge.

Each of the plurality of switches may be an electrically actuated switch positioned at the first end portion of the elongate key.

Each elongate key may be cantilevered being fixed to the substrate at the first end portion and the second end portion travels towards the substrate as a consequence of resilient flexing of the cantilevered substantially rigid elongate key when a load is applied by a user at the second end portion.

Each elongate key may be a self-supporting structure projecting into free space.

The only support for each of the second end portions may be their respective elongate keys which create open accessible volumes between the second end portions and the substrate.

The apparatus may further comprise dampers configured to dampen oscillations of the rigid elongate keys after user actuation of the second end portions.

The elongate keys may have an uneven weight distribution along their lengths.

The elongate keys may have an uneven thickness along their lengths.

Each of the second end portions may have a surface for actuation by a user and the surface may comprise a cut jeweler's stone.

The apparatus may further comprise one or more light sources, wherein each of the elongate keys is hollow having an interior volume that extends from the first end portion to the second end portion and wherein the interior volume guides light produced by the light source to the second end portion.

According to various, but not necessarily all, embodiments of the invention there is provided a keypad module for an apparatus comprising: a substrate; and a plurality of distinct rigid elongate keys wherein each elongate key comprises: a first end portion supported by the substrate and a second end portion separated by a dimension of the elongate key from the first end portion, and suspended from the substrate in free space by the elongate key.

According to various, but not necessarily all, embodiments of the invention there is provided an apparatus comprising: support means; a plurality of rigid elongate keys wherein each elongate key comprises: a first end portion supported by the support means and a second end portion separated by an intermediate portion of the elongate key from the first end portion, and suspended from the substrate in free space by the elongate key; and switch means for detecting travel towards the substrate of the second end portion of one or more of the plurality of elongate keys.

BRIEF DESCRIPTION OF THE DRAWINGS

For a better understanding of various examples of embodiments of the present invention reference will now be made by way of example only to the accompanying drawings in which.

DETAILED DESCRIPTION

Figure 1:
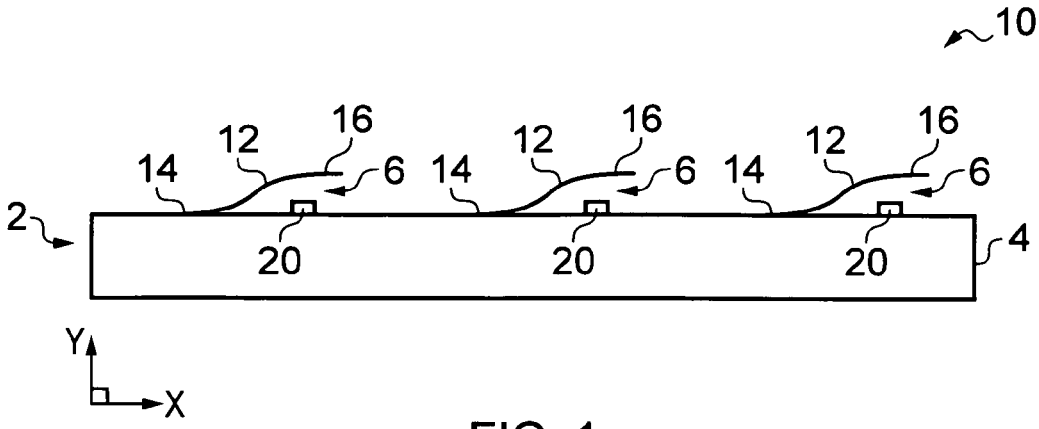
FIG. 1 schematically illustrates in cross-section a keypad according to a first embodiment.

The Figures schematically illustrate an apparatus 2 comprising: a substrate 4; a keypad 10 comprising a plurality of distinct substantially rigid elongate keys 12 wherein each elongate key comprises: a first end portion 14 supported by the substrate 4 and a second end portion 16 separated by an intermediate portion of the elongate key from the first end portion 14 and suspended from the substrate in free space by the elongate key 12; and a plurality of switches 20, wherein each switch detects travelling towards the substrate 4 of the second end portion 16 of a respective one of the plurality of elongate keys 12 in response to user actuation of the second end portion 16.

The elongate keys 12 may be defined as strip-like members having the dimensions length, width and depth, where the length is greater that the width at the width's widest point and the width is greater than the depth at the depth's widest point. The width may be a constant along the length or may vary along the length. The depth may be a constant along the length or may vary along the length.

The second end portion 16 is separated by either the width or the length of the elongate key from the first end portion 14. In the illustrated examples, the second end portion 16 is separated by the length of the elongate key from the first end portion 14.

Figure 3:
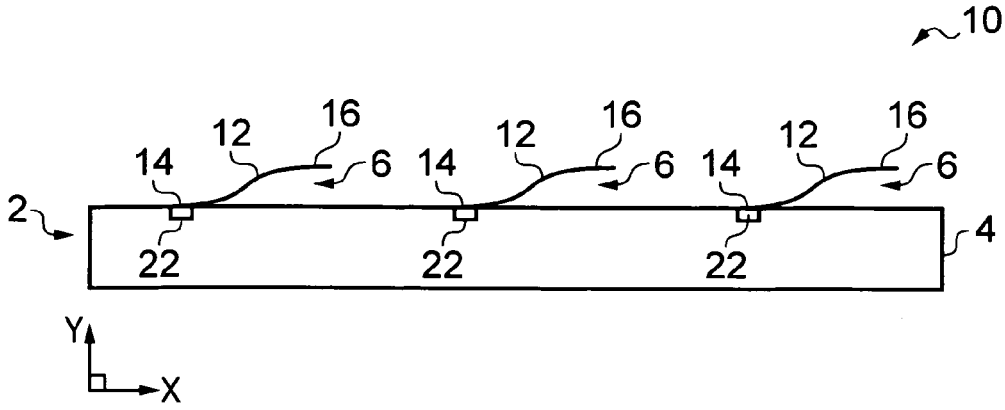
FIG. 3 schematically illustrates in cross-section a keypad according to a second embodiment.

Each elongate key 12 has a raised profile, for example, as illustrated in FIGS. 1 and 3.

Figure 2A:
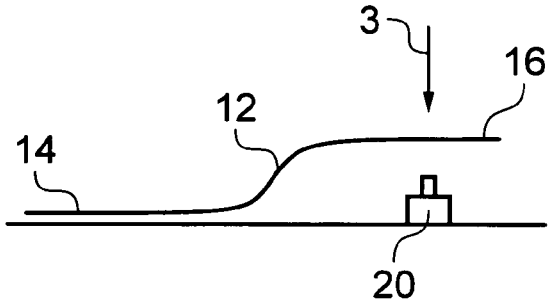
FIGS. 2A, 2B, 2C schematically illustrate in cross-section the keypad according to the first embodiment in use.
Figure 2B:
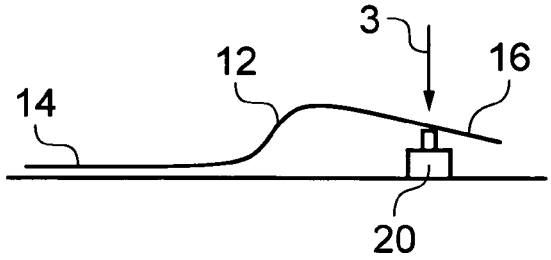
Figure 2C:
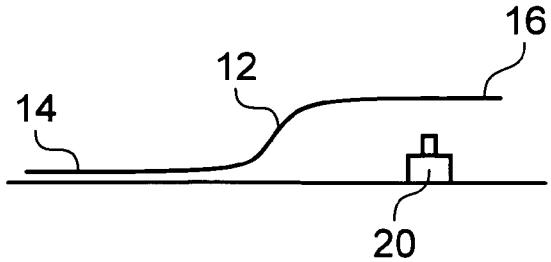
Figure 4A:
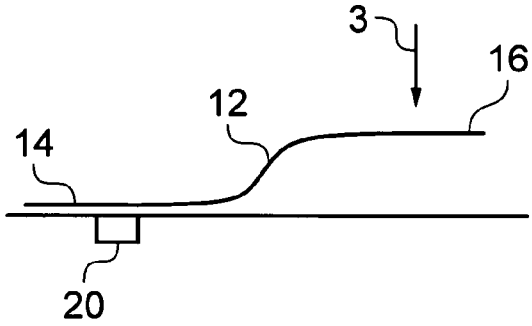
FIGS. 4A, 4B, 4C schematically illustrate in cross-section the keypad according to the second embodiment in use.

The first end portion 14 of the elongate key 12 has a fixed low profile. As the elongate key extends in a first direction x it is also displaced in direction y, raising the profile of the elongate key 12 through the intermediate portion, until it terminates at the second end portion 16 which is consequently suspended from the substrate in free space. The profile of the elongate key 12 varies from its neutral equilibrium profile (FIG. 2A, 4A) during use when the second portion is actuated 3 by a user (see FIGS. 2B, 4B) before returning to its neutral equilibrium profile (FIG. 2C, 4C) when the second portion is no longer actuated 3 by a user.

In the illustrated example, the profile in cross-section of the elongate key 12 approximates to a sigmoid function, however, it should be appreciated that many other raised profiles are possible that result in the second end portion 16 being suspended from the substrate 4 in free space.

The rigidity of an elongate keys 12 is such that it can support, when in neutral equilibrium, it's own weight and suspend the second end portion 16 in free space. Each elongate key 12 is a self-supporting structure that projects into free space.

The first end portion 14 of the elongate key 12 is tethered to the substrate and the rigidity of the elongate keys 12 is such that it will not break when the second end portion 16 travels towards the substrate 4 in response to user actuation 3 of the second end portion 16 but will resiliently flex and then return to is neutral equilibrium position when user actuation 3 of the second end portion 16 is released. The rigidity is dependent upon the geometry of the elongate key 12 and the material from which it is made. Increasing the moment of inertia of the elongate key increases its rigidity. Using a material with a larger elastic modulus also increases rigidity. The material may be any suitable material or mixture or composite of materials. The material may, for example, be metal such as stainless steel, aluminium etc. The material may alternatively comprise a composite such as carbon fibre composite. The resilient flexibility allows the second end portion 16 to return to the same neutral equilibrium position after user actuation 3 that it had before user actuation.

The tethering or fixing of the first end portion 14 of the rigid elongate key 12 to the substrate 4 forms a cantilever that resiliently flexes when a load is applied by a user at the second end portion 16 of the elongate key 12.

Figure 5:
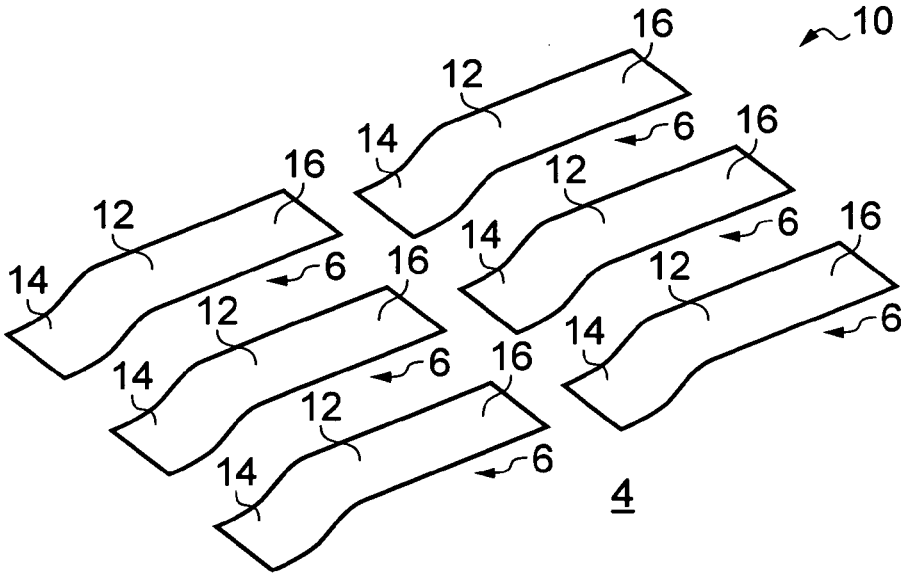
FIG. 5 schematically illustrate a keypad in perspective view.

The only support for the second end portion 16 of an elongate key 12 is the elongate key 12 itself. This creates an open accessible volume 6 between the second end portion 16 and the substrate 4 as illustrated in, for example, FIG. 5 which schematically illustrates the keypad 10 in perspective view.

Each of the plurality of elongate keys 12 has an associated respective switch 20. When the second end portion 16 of each elongate keys 12 travels, in response to user actuation of the second end portion 16, towards the substrate 4 the associated switch 20 detects this travel and provides an input signal to the apparatus 2.

In FIG. 1 and FIGS. 2A-2C each of the plurality of switches 20 is a physically actuated switch underlying the second end portion 16.

When the second end portion 16 of an elongate key 12 travels in response to user actuation 3 of the second end portion 16, from its neutral equilibrium position (FIG. 2A) towards the substrate 4, it actuates (FIG. 2B) the-underlying physically actuated switch 20.

When actuation 3 is released (FIG. 2C) the second end portion 16 of the elongate key 12 returns to its neutral equilibrium position for reuse. The switch is deactivated.

The underlying physically actuated switches 20 are positioned within the open accessible volumes 6 and are therefore exposed and visible to a user.

Figure 7:
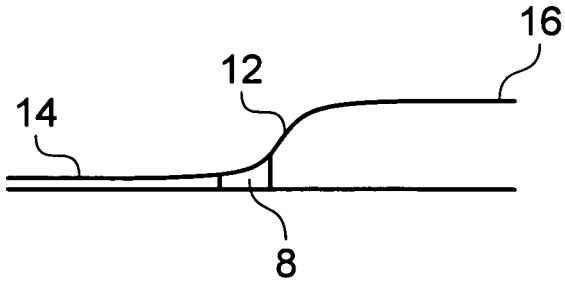
FIG. 7 schematically illustrate a damped key.

A damper 8 may be used, as illustrated in FIG. 7, to dampen any oscillations of the rigid elongate key 12 after user actuation and release of the second end portions 16. The damper may for example be a material that dissipates elastic energy such as felt etc.

In FIG. 3 and FIGS. 4A-4C each of the plurality of switches 20 comprises a strain gauge 22 positioned at, for example, the first end portion 14 of each elongate key 12.

Figure 4B:
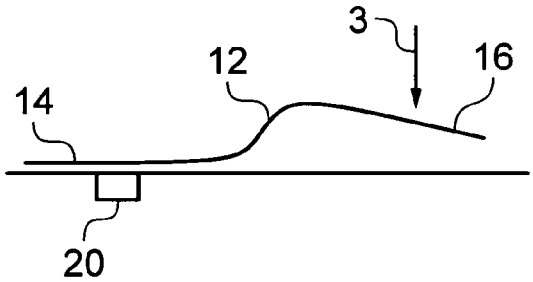
Figure 4C:
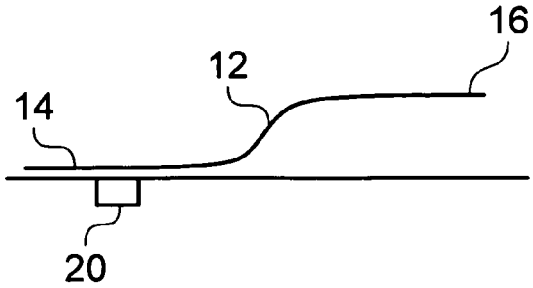

When the second end portion 16 of an elongate key 12, travels, in response to user actuation 3 of the second end portion 16, from its neutral equilibrium position (FIG. 4A) towards the substrate 4, the strain created along the elongate key 12 is detected as a local strain at the first end portion 14 by strain gauge 22. The strain gauge 22 is calibrated so that a switch is actuated whenever the detected strain exceeds a predetermined threshold (FIG. 4B). The predetermined threshold typically corresponds to a particular deflection of the second end portion 16 of an elongate key 12 towards the substrate 4 from its neutral equilibrium position.

The strain gauge 22 may be electrically activated. For example, the strain gauge may measure an electrical property of a reference material that varies as the material is strained. Electrical properties that may vary with strain include electrical resistance and dielectric constant (capacitance). There are well known systems for detecting changes in such electrical parameters. The reference material may be the material of the elongate key 12 itself or may be material of a patch securely applied to the elongate key 12.

When actuation 3 is released (FIG. 4C) the second end portion 16 of an elongate key 12 returns to its neutral equilibrium position for re-use.

A damper 8 may be used, as illustrated in FIG. 7, to dampen any oscillations of the rigid elongate key 12 after user actuation and release of the second end portions 16. The damper may for example be a material that dissipates elastic energy such as felt etc.

Figure 8:
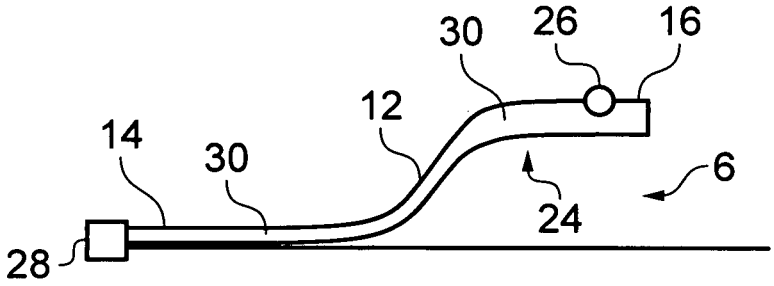
FIG. 8 schematically illustrate a key operating as a light guide.

FIG. 8 schematically illustrates, in a cross-sectional view, a key of the keypad 10. The elongate key 12 forming the key has, in this example, a non-uniform distribution of mass along its length. This non-uniform distribution may be achieved by maintaining a constant average density along the length and by varying the volume of material along the length by, for example, varying the width or depth of the elongate key 12. This non-uniform distribution may also be achieved by placing higher or lower density materials at certain positions along the length of the elongate key 12. This weighting of the key may provide an improved tactile experience for the user when actuating the key.

In this example, an upper surface of the elongate key 12 comprises at the second end portion 16 where the upper surface is for actuation by a user, a cut jeweler's stone 26 such as precious or semi-precious gemstone.

The apparatus 2 illustrated in FIG. 8 also comprises a light source 28 at the substrate 4 near the first end portion 14 of the elongate key 12.

Figure 6:
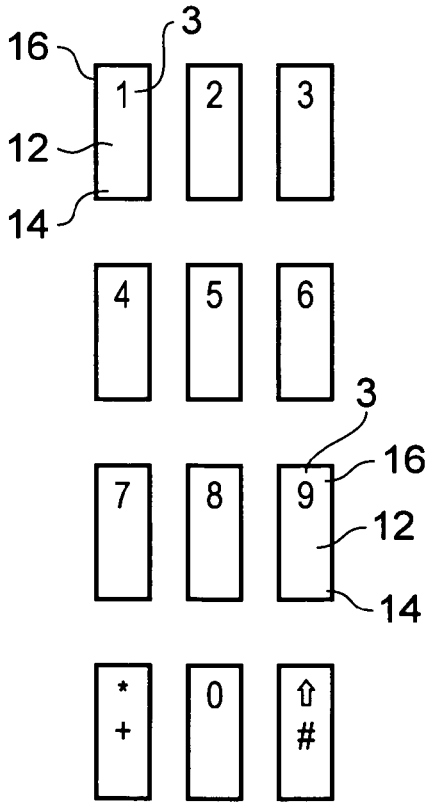
FIG. 6 schematically illustrate a keypad in plan view.

In this example, the elongate key 12 operates as a light guide. The elongate key 12 is hollow having a continuous interior volume 30 that extends from the first end portion 14 through the intermediate portion to the second end portion 16. The continuous interior volume 30, which may comprise air or another dielectric, guides light produced by the light source 28 to the second end portion 16 where it is emitted through one or more apertures. The apertures 3 may, for example, be etched graphics or indicia (FIG. 6). In this particular example, the light is emitted through the stone 26.

Figure 9:
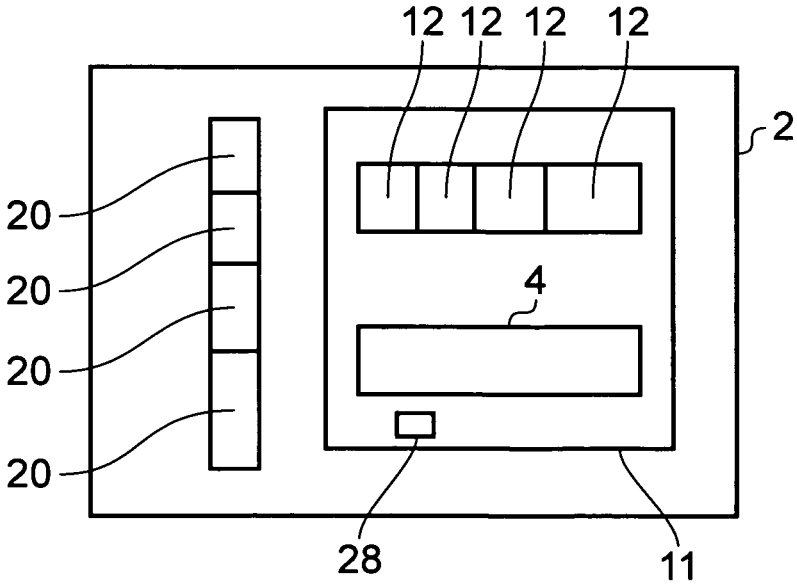
FIG. 9 schematically illustrates the functional components of the apparatus.

FIG. 9 schematically illustrates the functional components of the apparatus 2 according to one embodiment. The apparatus comprises: a substrate 4, a plurality of elongate keys 12 and a plurality of switches 20. These components may be the same or similar to the corresponding components described with reference to the preceding figures and may operate as described. In this example the substrate 4 and plurality of elongate keys 12 are comprised in a keypad module 11. The keypad module 11 may exist as an independent commercial product that is combined with the switches 20 during manufacture of the apparatus 2. As used here 'module' refers to a unit or apparatus that excludes certain parts/components that would be added by an end manufacturer or a user.

The keypad module 11 comprises: a substrate 4; and a plurality of distinct rigid elongate keys 12 wherein each elongate key comprises: a first end portion 14 supported by the substrate 4 and a second end portion 16 separated by an intermediate portion of the elongate key from the first end portion, and suspended from the substrate in free space by the elongate key, for example, as illustrated in FIGS. 1 to 8. The keypad module may also comprise a light source 28 as described with reference to FIG. 8.

The apparatus 2 may be a hand-portable electronic apparatus such as a personal music player, a mobile telephone, a personal digital assistant etc.

Although embodiments of the present invention have been described in the preceding paragraphs with reference to various examples, it should be appreciated that modifications to the examples given can be made without departing from the scope of the invention as claimed.

Features, described in the preceding description may be used in combinations other than the combinations explicitly described.

Although functions have been described with reference to certain features, those functions may be performable by other features whether described or not.

Although features have been described with reference to certain embodiments, those features may also be present in other embodiments whether described or not.

Whilst endeavoring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

We claim:

1. An apparatus comprising:

a substrate;

a keypad comprising a plurality of distinct substantially rigid elongate keys wherein each elongate key comprises:

a first end portion supported by the substrate and a second end portion separated by an intermediate portion of the elongate key from the first end portion, and suspended from the substrate in free space by the elongate key; and a plurality of switches, wherein each switch is configured to detect travelling towards the substrate of the second end portion of a respective one of the plurality of elongate keys in response to user actuation of the second end portion, wherein each of the second end portions has a surface for actuation by a user and the surface comprises a cut jewelers' stone.

2. An apparatus comprising:

a substrate;

a keypad comprising a plurality of distinct substantially rigid elongate keys wherein each elongate key comprises:

a first end portion supported by the substrate and a second end portion separated by an intermediate portion of the elongate key from the first end portion, and suspended from the substrate in free space by the elongate key;

a plurality of switches, wherein each switch is configured to detect travelling towards the substrate of the second end portion of a respective one of the plurality of elongate keys in response to user actuation of the second end portion, and one or more light sources, wherein each of the elongate keys is hollow having an interior volume that extends from the first end portion to the second end portion and wherein the interior volume is configured to guide light produced by the light source to the second end portion.

3. A keypad module for an apparatus comprising;

a substrate; and a plurality of distinct substantially rigid elongate keys wherein each elongate key comprises:

a first end portion supported by the substrate and a second end portion separated by an intermediate portion of the elongate key from the first end portion, and suspended from the substrate in free space by the elongate key, wherein each of the elongate keys has a first section along a first length of the key having a first cross sectional thickness between a top side and a bottom side of the key, and a second section along a second different length of the key having a different second cross sectional thickness between the top side and the bottom side of the key, and further comprising one or more light sources, wherein each of the elongate keys is hollow having an interior volume that extends from the first end portion to the second end portion and wherein the interior volume is configured to guide light produced by the light source to the second end portion.

4. A keypad module for an apparatus Comprising:

a substrate; and a plurality of distinct substantially rigid elongate keys wherein each elongate key comprises:

a first end portion supported by the substrate and a second end portion separated by an intermediate portion of the elongate key from the first end portion, and suspended from the substrate in free space by the elongate key, wherein each of the elongate keys has a first section along a first length of the key having a first cross sectional thickness between a top side and a bottom side of the key, and a second section along a second different length. of the key having a different second cross sectional thickness between the top side and the bottom side of the key, wherein each of the second end portions has a surface for actuation by a user and the surface comprises a cut jewelers' stone.

5. A keypad module as claimed in claim 4, wherein each elongate key is cantilevered being fixed to the substrate at the first end portion and wherein the second end portion travels towards the substrate as a consequence of resilient flexing of the cantilevered substantially rigid elongate key when a load is applied at the second end portion.

6. A keypad module as claimed in claim 4, wherein each elongate key is a self-supporting structure projecting into free space.

7. A keypad module as claimed in claim 4, wherein the only support for each of the second end portions is their respective elongate keys which create open accessible volumes between the second end portions and the substrate.

* * * * *